US005970560A

United States Patent [19]

Leroux

[11] Patent Number: 5,970,560

[45] Date of Patent: Oct. 26, 1999

[54] IMPLEMENT FOR SIMULTANEOUSLY DRYING A SURFACE AND COLLECTING A LIQUID

[76] Inventor: Willy Leroux, 28 Rue Auber, 06000, Nice, France

[21] Appl. No.: 08/945,794

[22] PCT Filed: May 10, 1996

[86] PCT No.: PCT/FR96/00703

§ 371 Date: Nov. 10, 1997

§ 102(e) Date: Nov. 10, 1997

[87] PCT Pub. No.: WO96/35366

PCT Pub. Date: Nov. 14, 1996

[30] Foreign Application Priority Data

May 11, 1995 [FR] France ..... 95 05598

[51] Int. Cl.[6] ..... A47L 13/12; A47L 13/11

[52] U.S. Cl. ..... 15/121; 15/119.1; 15/119.2; 15/245

[58] Field of Search ..... 15/118, 119.1, 15/121, 245, 245.1, 236.01, 119.2

[56] References Cited

U.S. PATENT DOCUMENTS

| | | | |
|---|---|---|---|
| 2,625,700 | 1/1953 | Baldwin | 15/121 |
| 2,631,326 | 3/1953 | Smith, Jr. | 15/121 |
| 3,229,217 | 1/1966 | Lindefelser | 15/121 |
| 4,114,224 | 9/1978 | Disko | 15/229.2 |
| 4,902,544 | 2/1990 | Kim et al. | 428/36.1 |
| 5,448,793 | 9/1995 | Mallory et al. | 15/232 |

FOREIGN PATENT DOCUMENTS

| | | | |
|---|---|---|---|
| 3735747 | 4/1991 | Germany | 15/121 |

*Primary Examiner*—Elizabeth McKane
*Attorney, Agent, or Firm*—Dennison, Meserole, Scheiner & Schultz

[57] ABSTRACT

An implement for drying a surface and for simultaneously recovering a liquid from the surface includes a drying blade of flexible material secured to a hand-held support, the drying blade having a linear leading edge for scraping the surface and for drying the surface by establishing a bead of the liquid behind the leading edge on an inside face of the drying blade, and a substrate having a face fixed to a face of the drying blade adjacent the linear leading edge and which collects the bead of liquid established behind the linear leading edge. This substrate constitutes a drying and liquid recovery head.

19 Claims, 5 Drawing Sheets

FIGURE 2
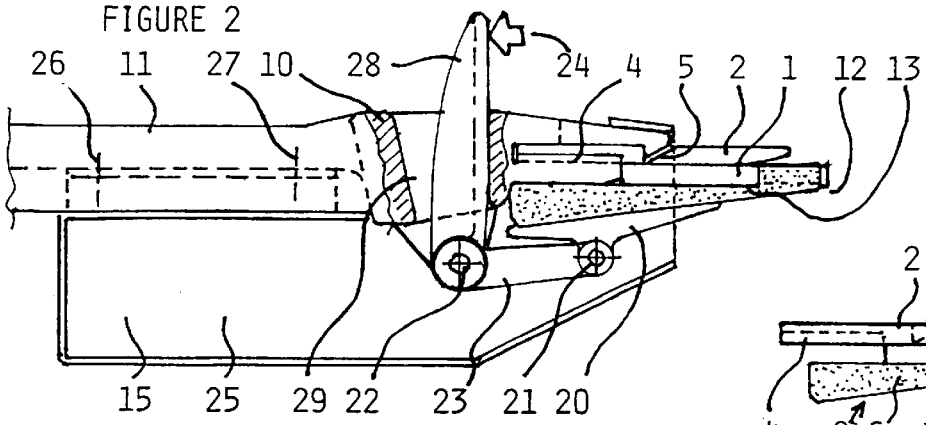
FIGURE 1
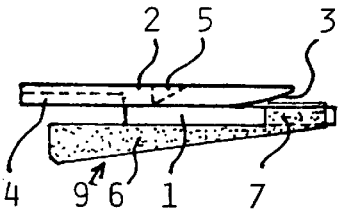
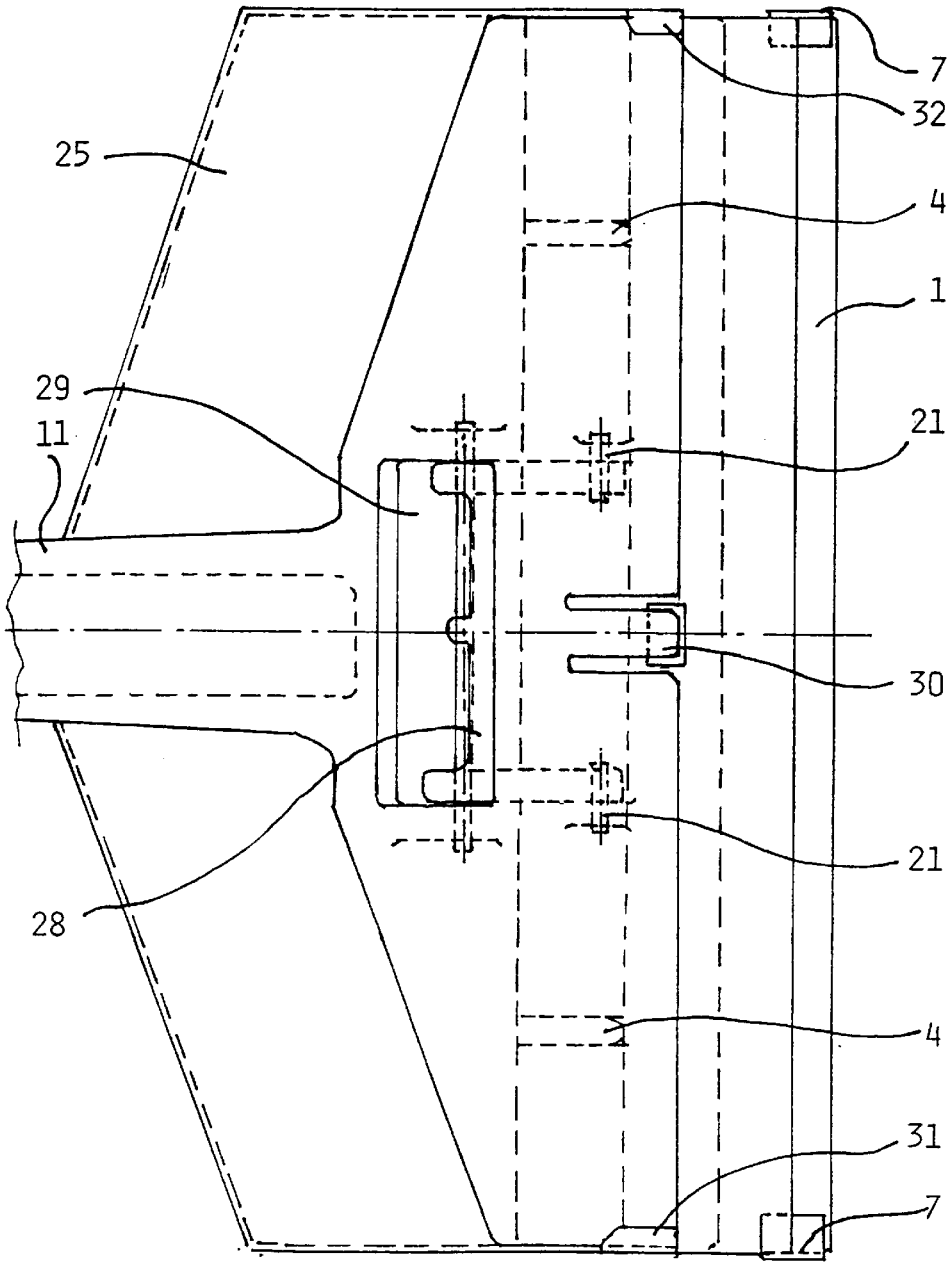
FIGURE 3

FIGURE 4
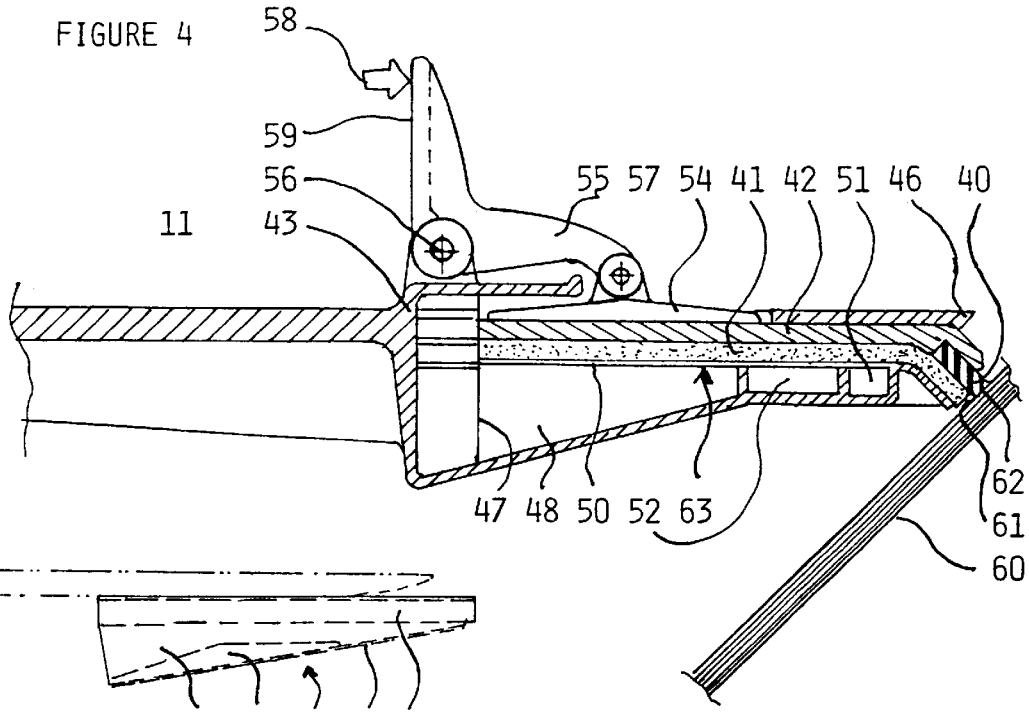
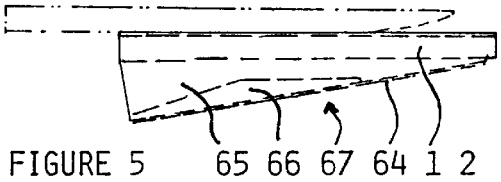
FIGURE 5
FIGURE 6
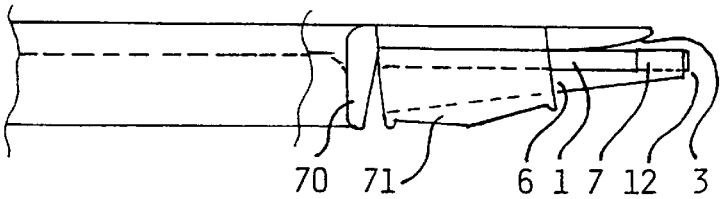
FIGURE 7
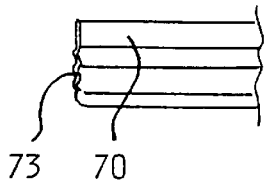
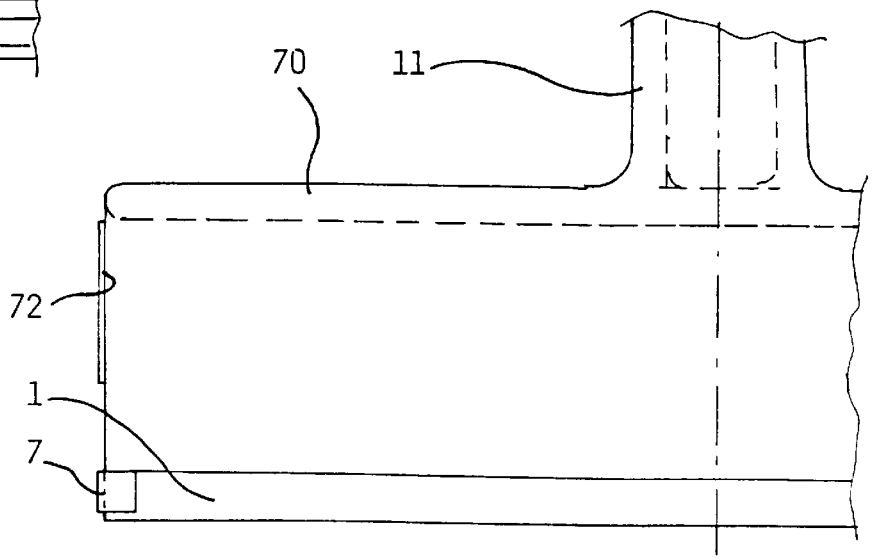
FIGURE 8

IMPLEMENT FOR SIMULTANEOUSLY DRYING A SURFACE AND COLLECTING A LIQUID

BACKGROUND OF THE INVENTION

The invention concerns an implement designed to dry and to recover a cleaning liquid present on a surface, such as a glazed surface, for example, or even a floor, said liquid is a cleaning product and/or condensed vapor containing dirt previously or simultaneously dissolved and dispersed. It comprises a flexible blade of a type known in itself for drying the liquid, as found on many cleaning implements, squeegees and bladed cleaning devices, on which is mounted a capillary substrate for recovering the liquid. The thin and flexible blade has a linear leading edge adapted to scrape the smooth surface and co-operates with the substrate for collecting the bead of liquid that forms under the inside face of the blade as it moves over the surface. Said recovery and drying system can be used on any type of squeegee and surface cleaning device.

In the case of cleaning vertical glazed surfaces, with a conventional single squeegee having a flexible blade, as the squeegee is moved said blade scrapes the liquid film and accumulates along its leading edge a bead of liquid including dirt previously taken up into suspension by mechanical and detergent action (for example with a sponge and a detergent). This bead of liquid remains under the blade for as long as the surface tension forces compensate the weight of the bead. If this equilibrium is broken, in particular on the arrival of the continuous flow produced by the forward movement of the blade, the bead grows and breaks up, and any runs that are not intercepted flow over the frame and then over the wall and floor.

The liquid capture device must simultaneously solve the problems of engorgement by the inflow of dirty liquid, preserving the equilibrium of the bead of liquid moving with the drying blade, preventing the bead from running, preventing runs on the surface to be cleaned, and preventing smearing by the edges of the blade. It is obvious that the dirt must previously have been entirely taken up in suspension and/or dispersed in the liquid to be dried, whether by manual mechanical action or by spraying vapor and detergent product, as the drying implement is not designed to fulfil this function.

Consumers, housewives and other non-professionals, use these squeegees after performing a mechanical action with a mop, a sponge, etc. impregnated with a detergent solution to dissolve and disperse the dirt present on the surface.

It is also impossible to dry without leaving smears because they do not have the skills of the professional window cleaner. Each time they put the drying lip back on the part of the window that it has already dried, for another pass, because the blade is already wet on the other side of its leading edge it leaves a smear. Moreover, on each new pass, the leading edge of the bead of liquid produces not only runs due to the breaking of the equilibrium of said bead, but also leaks of dirty liquid at the ends of the lip, leaving other large and continuous smears, above the squeegee, which must be removed with a cloth. Prior art electromechanical systems have solved some of these problems, but have given rise to others that are unacceptable and which are extremely costly, in particular for consumer use. Pump systems are necessarily provided with a suction unit level with the drying blade. Even if it is bevelled, this unit prevents complete drying of the window near the frame because the unit abuts thereagainst, which is unacceptable. The same applies to glass doors and other surfaces, because it is not possible to circumvent everything projecting from the vertical or horizontal surfaces, handles, hinges, etc. This phenomenon is accentuated when using a long rod to work high up because of the reduced angle of attack of the blade, which renders it unusable. The bottom of the window and the frame then have to be finished off manually with a cloth, which is also unacceptable. Electrical equipment of this kind imposes the additional handicap of using a battery or a long electrical power supply cable. Also, it is not possible to move a squeegee of this kind in the horizontal direction without leaving linear smears.

Other, low-cost techniques known in themselves use a sponge disposed under the drying blade of the squeegee. They do not solve the problem of correct drying of the surface: smears at the edges of the lip on each new pass and leaks from the lateral edges of the lip and the bottom edge of the glass because of the thickness of the sponge. Furthermore, because the sponge touches the glass, it produces very high friction forces that stop the physical-chemical action of sliding of the lip over the glass, which makes the squeegee impossible to handle.

SUMMARY OF THE INVENTION

The aim of the present invention is to remedy these disadvantages and to provide an implement that can be fitted to simple or sophisticated squeegees and to cleaning devices including a surface drying blade, which is of simple and economic design and simple and effective to use, recovering the cleaning liquid without auxiliary and highly costly suction means, leaving no smears from the drying blade or linear smears from the edges even when moved horizontally, or smears of cleaning product, enabling direct finishing of the lower edge of the glass as far as the frame for vertical surfaces, leaving no smears and recovering the liquid from horizontal surfaces, requiring no professional training and no powerful electromechanical suction and pumping equipment that is costly and difficult to handle to obtain these results. In the case of cleaning large horizontal surfaces, for example floors, the prior art suction and pumping cleaning systems are justified despite their high cost because of the amount of liquid used. On the other hand, direct suction of the bead of liquid near the leading edge of the drying blade has the major disadvantage of pumping air at the same time as the liquids. This leads to very high pump throughputs and therefore to powerful and very costly equipments such as suction turbines.

The drying implement of the invention, suitable for floor cleaning devices, remedies this drawback, considerably reducing the power of the electromechanical pump, by eliminating the need for suction of the liquid, and thus also suction of air, because the pumping is done directly in the liquid collectors at the rear of the implement, fed by the capillary layer replacing the suction unit which captures said liquid and transfers it into this collector. The throughput of the pump is then very low. The suction unit of these devices, designed to aspirate this liquid, cannot be wide because of the very high suction power that would then be necessary. As a result it is necessary to effect a much greater number of passes over floors, which are usually very large in area. Hence a great saving in time, cleaning costs and highly costly equipment is achieved with recovery by means of a capillary substrate. Only so-called auto-washing machines have a high power and can suck over a larger surface area, possibly equivalent to that of the drying head of the invention, but with an enormous difference in terms of cost and overall size.

The device in accordance with the invention for recovering the bead of liquid avoiding running and smears comprises a drying head that extends the whole length of the blade and which is disposed under its inside face, slightly set back from the leading edge of the recovery and drying blade. Because of this particular arrangement of the device for collecting the liquid bead at source, the liquid is evacuated continuously as the bead is formed on displacement of the implement over the surface, in such manner as to prevent said bead breaking up.

Furthermore, the drying head acts only on the squeegeed liquid, i.e. liquid containing dirt in suspension.

In accordance with an advantageous feature of the invention, the drying and liquid recovering means are formed by a spongy material or for example by a substrate of a highly capillary, highly absorbent, hydrophilic or similar material such as is already available or may become available in the future, one edge of which, called the active edge, extends the entire length of the drying blade and along its lateral sides, which also prevents any leakage at the sides and at the top. Thus capture is started automatically in the dry state by capillary action as the bead of liquid is formed and continues entirely automatically and in a natural fashion as the cleaning implement moves.

Additionally, the capillary substrate being in the form of a cloth, its texture naturally pumps the squeegeed liquid at its active edge by absorption and capillary action and transfers the liquid towards the rear. Each time that the blade is moved away from the surface, the capillary action continues, subject to its absorption capacity, which dries the edge of the blade near its leading edge. This prevents the risk of liquid being present on the other side of the edge of the blade each time the operator places the blade on the surface again for a new pass and prevents the formation of liquid smears above the blade as it moves and at the place where the blade is applied.

Said implement of the invention can be used on all types of implements or devices fitted with a drying blade, for example: simple or disposable squeegees; sophisticated squeegees including a sponge for dissolving and/or dispersing dirt; squeegees co-operating with a sponge increasing its autonomy; devices provided with a nozzle for emitting vapor and/or detergent; devices effecting vaporation, rubbing and suction successively and other professional and non-professional devices for cleaning windows or vertical, horizontal or oblique surfaces, etc.

BRIEF DESCRIPTION OF THE DRAWINGS

The features and advantages of the cleaning implement of the invention will emerge more clearly from the following description with reference to the accompanying drawings given by way of non-limiting example, in which:

FIG. 1 shows one example of an interchangeable drying and liquid recovery head of the invention, glued to a support that can be clipped to any type of implement or device;

FIG. 2 shows one example of a drying and recovery implement of the invention in cross-section, fitted with its drying head, a squeezing unit and a liquid collector;

FIG. 3 shows a plan view of the implement from FIG. 2;

FIG. 4 shows a one embodiment of a disposable or non-disposable implement in section, with a simplified way of fitting the drying head;

FIG. 5 shows a view in elevation of another version of the disposition of the drying head, showing a second embodiment of the implement of the invention;

FIGS. 6, 7 and 8 show a side view and a partial top view of a disposable squeegee;

DESCRIPTION OF PREFERRED EMBODIMENTS

Figure 9:
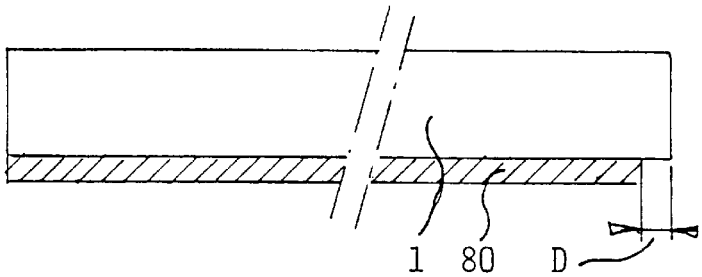
FIGS. 9 through 12 show sectional views to a larger scale of the drying head with various types of capillary substrate.

As shown in FIG. 1, the drying and recovery head seen in elevation includes a thin and relatively flexible blade 1 of generally rectangular shape made from an elastomer or similar material or from pure rubber glued to a plate 2 injection moulded from plastics material with a rounded shape 3 to limit bending of the blade 1 and at least one lateral guide consisting of a groove 4 disposed under the rear of the plate 2 extending beyond the blade 1, a clip housing 5 on the top of said plate, and a highly capillary and/or absorbent substrate 6 fixed under said blade and one part 7 of which locally protects each lateral edge of said blade 1. Said drying and liquid recovery head will be referred to hereinafter using the reference number 9. The nature and the fixing of the capillary substrate will be described in more detail in connection with FIGS. 9 through 13. Equipped as shown, the drying head 9 can be fitted to all types of cleaning implements or devices (for glazed surfaces or smooth surfaces, walls, vehicle bodywork, floors of various kinds, kitchen furniture, tops of office furniture, institutional furniture, etc.) having a drying blade and complementary clip means. Even more simply, the blade 1 equipped with its capillary substrate 6, 7 can be glued directly in place of the drying blade to all the previously mentioned types of implements and devices or fixed by any means known in itself.

FIGS. 2 and 3 show one example of a drying and recovery implement of the invention designed to recover liquid containing dirt in suspension from and to dry surfaces to be cleaned, such as a glazed surface, for example, forming part of a window or constituting a vehicle windshield. This liquid can be water or a water-alcohol mixture or a special-purpose cleaning liquid, etc. The drying and recovery implement can also function on a cleaning device emitting vapor only or vapor mixed with a cleaning product and to this end includes a spray nozzle added to said implement with its control means.

This implement has a body 10, injection moulded from a plastics material, for example, adapted to receive the drying head 9 and one part 11 of which forms a handle so that it can be manipulated easily. The generally rectangular blade 1 has a linear leading edge 6 adapted to dry and to remove liquid from the glazed or other surface. The capillary substrate is designed to capture the bead of liquid that forms under the inside face 13 of the blade 1 as said blade is moved over the glazed face.

This bead or "front" is made up of a mixture of dirt and liquid, remaining under the blade of the squeegees used by professional window cleaners for as long as the surface tension forces compensate the weight of said bead. As the blade is moved forward and the bead grows in size, this equilibrium is destroyed and the bead of liquid breaks up, causing runs. It then builds up again until the equilibrium is broken again, so causing successive waves of runs. The capillary substrate 6 that extends under all of the blade 1 and along its lateral sides 7 is under the inside face 13 and slightly set back from the leading edge 12 of the blade 1. It is situated in the region in which the bead of liquid forms. The edge of the drying head is preferably about 0.5 mm from the leading edge 12 of the blade 1 so that the substrate is about 0.3 mm from the bead (front), the remaining part as far as the leading edge of the blade providing a seal by flexing onto the surface. For the drying blade to work efficiently and continuously, the drying head 9 is associated with a squeegeed liquid collector 25. By virtue of this feature, as the bead of dirty liquid forms, the drying head 9 prevents the critical mass of said bead being reached by absorbing the dirty liquid as and when it is collected by the blade. To prevent engorgement of the capillary substrate, means are provided to exert pressure on the rear of the capillary substrate, this action being similar to squeezing a sponge.

Professional devices can use a pivoting flap, for example, which is pressed manually to squeeze the rear of the substrate. Better still, a pivoting plate 20 acting across all of the width of the blade 1 can be used to assure this function of wringing out the substrate, for example, including, at the bottom, two pivots 21 co-operating with those 22 of a lever 23 which is pulled in the direction of the arrow 24 to squeeze the substrate to expel the excess liquid therefrom.

In professional devices there is a small collection tank 25 fixed under the handle 11 of the implement, by means of screws 26, 27. The operating handle 28 of the lever 23 passes through a cut-out 29 in the body 10 to emerge on the top of the implement. The tank 25 also has two lugs 31, 32 applied elastically to the edges of the body 10. When the capillary substrate is filled with particles of dirt, residues and cleaning sludge, the lever 30 is unclipped and the drying head is replaced with a clean head. This function of wringing out the substrate can of course be assured by any means known in itself, for example a lever on the handle operable directly by the index finger.

FIG. 4 shows in section another embodiment of a drying blade 40 and its capillary substrate 41 retained in a net glued to a substrate 42 disposed on top of the body 43 and together forming a removable drying and recovery head 45 retained elastically by clips 46 at the ends of the body 43. Across all of the width of the implement the blade 40 is very short and glued into a housing of the support 42 disposed perpendicularly to the surface to be dried. The body 43 has a slide on the inside of its lateral sides for positioning the support 42 of the drying head, which abuts on a rib 47. In this version of the implement, there is a tank 48 for collecting the recovered dirty liquid. The capillary substrate 41 rests on a gridded plate that can optionally be contained in the net protecting the substrate 41. Compartment 51 is provided to receive solids making their way up through the substrate and compartment 52 is provided to receive undissolved residual sludge. As in the version from FIGS. 2 and 3, a pivoting pressure plate 54 is provided all along the blade and the substrate, moved by a lever 55 pivoted to the body 43 at 56 and to the pivoting pressure plate at 57. It is sufficient to apply pressure to the handle 59 in the direction of the arrow 58 to squeeze the substrate to expel from it excess liquid that is collected in the tank 48. The figure shows the blade 40 pressed into sealing engagement with a surface 60 and a liquid bead 61 having a diameter in the order of 0.5 millimeters at the leading edge of the blade 40.

In this version, the capillary substrate can be thick and long, and therefore have a high absorption volume giving the implement greater autonomy before emptying the overflow. The substrate is about 0.5 millimeters from the leading edge 62 of the blade. Depending on its thickness, it can allow high speeds of displacement of the blade and therefore an appreciable time saving compared to other shapes and dispositions of the capillary substrate.

FIG. 5 shows the simplest version of the drying head comprising its blade 1 equipped with its capillary substrate 65, a fixing net of which is glued to the top of the blade 1, and with a wringer plate 66 for the substrate, contained in said net 64 for protecting the substrate and fixing it to the blade 1. The drying head 67 including its wringer plate can be glued to a commercially available disposable squeegee body 70, or to that shown in FIG. 6, or to a plate 2 from FIG. 1, shown in dashed outline, to render it interchangeable.

FIGS. 6, 7 and 8 are fragmentary elevation, end and top views of a very simple squeegee that is discarded when the substrate is engorged with undissolved sludge, i.e. the drying head is not interchangeable. This drying head includes a plate 71 for wringing out the substrate fixed, for example glued, to each side 72 of the body 70 by a thin web 73 with concertina folds to facilitate bending during wringing out of the substrate 6.

The capillary substrate can be made in various ways without departing from the scope of the invention: it can be a spongy material made from various open cell synthetic materials, a woven or non-woven hydrophilic material, any highly absorbent fibrous material, etc. The advantage of non-woven materials is that they allow solids present in the liquid to be dried to pass through them. In the case where the liquid to be dried is a condensate of vapors and microdroplets described in patent PCT/FR93/00290, when this liquid dries in the substrate it becomes soluble again almost instantaneously on contact with this type of liquid condensate, which is not generally the case. Tests have indicated continuous self-cleaning of the substrate with this liquid.

The capillary substrate is in the form of a cloth 80 (FIG. 9) the so-called active edge 12 of which extends at least the whole length of the drying blade 1 and is fixed to this blade. The thickness of this cloth is chosen so that it does not come into contact either with the liquid present on the surface or with the surface.

The cloth 80 is made of a material including hydrophilic filaments, for example. It is strengthened by an exterior second cloth constituting a mesh forming a fine voile-like "tulle", made from mechanically strong fibers that can withstand heat and aggressive products, hot solvents, etc. when used with a spray of vapor and detergent products. This combination provides good capillary action for capturing and transferring the liquid to the collector 25, 48 and makes the cloth relatively durable.

In the preferred embodiment, as shown in FIGS. 1 through 6, the cloth 22 is preferably a high capillarity, absorbent, hydrophilic or spongy material made of natural and/or artificial fibers, interleaved or not, of the felt or similar type, gluable or applicable by any means known in itself directly on the area of the inside face of the blade 1, slightly set back relative to the leading edge 12. The various versions of the drying head can be mass produced. In one advantageous implementation the cloth 80 is of non-woven fabric, with a thickness 4 to 5 millimeters in a plurality of layers such that the thickness near the leading edge does not exceed 0.2 millimeters, having a maximal capillarity and a flowrate greater than that of woven or mesh cloth, to favor the transfer of dirt to the liquid recovery collector. Even when saturated, if the rear end of the cloth is squeezed to remove excess liquid it continues to capture the liquid from the bead at the front. In the disposable version of the recovery and drying implement from FIGS. 5 to 8, and in domestic applications, the capillary substrate can incorporate absorbent crystals such as silica gel in its fibers.

To be able to dry vertical surfaces properly, for example windows, it is indispensable to retain a minimal distance D from the leading edge 12 of the blade 1 which comes into sealed contact with the surface and acts as a drier behind which the liquid bead is formed.

Figure 10:
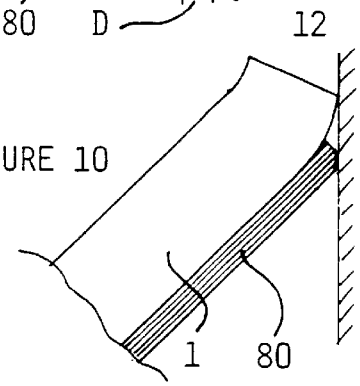

To limit the volume of this bead and to remain well short of the point at which its equilibrium breaks down, the capillary cloth 80 must be moved nearer the edge of the blade 1 to instigate capture as close as possible to the bead. If the capillary cloth 80 is too close to the edge of the blade, as shown in FIG. 10, it comes into contact with the surface, impedes sliding of the blade 1 and prevents correct formation of the liquid bead. A compromise therefore has to be found between: the proximity of the capillary cloth 80 to the leading edge of the blade 1 the formation and maintenance of the bead and its capture by capillary action at a flowrate sufficient to avoid it breaking up and running.

The optimal volume of the bead depends on the speed at which the blade is drawn over the surface and the capillary absorption capacity of the cloth. It is preferable for the absorption capacity of the cloth to be slightly greater than is strictly necessary.

Figure 11:
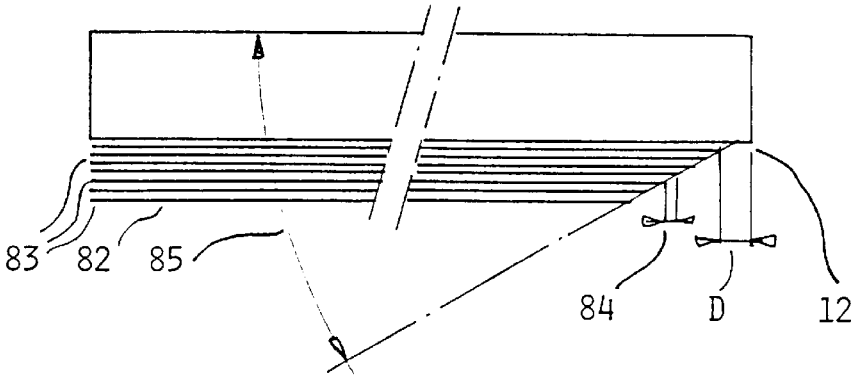

To illustrate this generous absorption capacity of the cloth, FIG. 11 shows a cloth 82 made up of a plurality of layers 83 disposed in a stepped configuration 84 starting at the optimal distance D. The first layer of the cloth 82 is nearest the active edge of the end of the blade 1. It is the first layer to begin to capture liquid from the bead.

As the bead grows, it comes into contact with the successive capillary layers that increase the capture capacity. This arrangement limits capillary pumping and optimizes the size of the bead regardless of the speed at which the blade moves over the surface. It produces a very strong capillary action of the cloth 82 without risk of coming into contact with the surface, as shown in FIG. 10, regardless of the inclination of the blade 1. The length 84 between successive layers is determined according to the minimal angle 85 of the drying blade.

Figure 12:
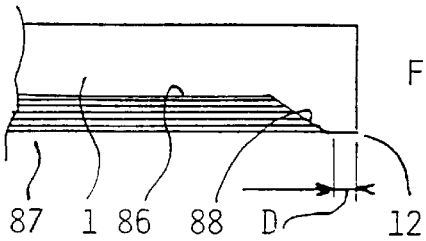

FIG. 12 shows a variant embodiment of the capillary cloth from FIG. 11. The blade 1 is extruded with a housing 86 to receive the cloth 87. This housing has a part with a slope 88 of about 45°. The various layers of the capillary cloth 87 are disposed at this angle 88 and can largely exceed the thickness of 0.5 millimeters.

Figure 13:
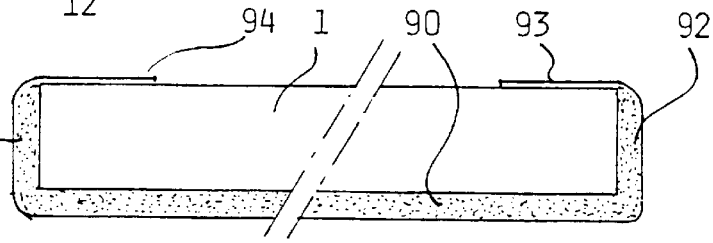
FIG. 13 shows a blade viewed from the front equipped with a capillary substrate protecting the lateral edges of the blade.

FIG. 13 is a diagrammatic view of a blade 1 seen end-on, provided with its capillary cloth 90, which rises up the lateral sides 91 and 92 of said blade. The net holding the cloth is glued to the top of the blade 1. This arrangement prevents smears at the top and running at the sides over vertical, oblique and horizontal surfaces, and enables the blade to be moved horizontally without the top and ends leaving smears. To avoid gluing the capillary layer 90 to the bottom of the blade 1, because gluing reduces the capillary qualities of the cloth, the net 93, 94 is made from a fine-mesh woven fabric, for example polyamide with non-hydrophobic treatment and is glued beforehand to the parts of the blade receiving the cloth, i.e. the bottom and lateral sides, the cloth is then fitted and covered with the woven fabric mesh, which is then stretched and glued outside the cloth to the top and to the rear of the blade. This arrangement enables the use of capillary materials of the kind used in highly absorbent diapers for babies, in addition to interleaved, mesh or non-woven fabrics.

The fibers are preferably oriented to transfer the captured liquid only to the rear of the blade, the capillary action being unidirectional, as in "RETENSORBES" or "SPHAIGNES" fibers used in some diapers and sanitary towels, for example.

As with diapers, the capillary substrate can be entirely ready for use within its net, which merely has to be glued to the top of the blade in an automatic machine.

In applications to vertical surfaces, the capillarity of the cloth is assisted by gravity, which facilitates evacuation of the liquid in the collector.

In applications to horizontal surfaces, and in particular floors, the capillary mass must be larger. The periodic squeezing of the cloth also prevents saturation of the capillary mass, as when working on vertical surfaces. Because the surface areas are much larger, the liquid capacity of the drying implement will be insufficient to dry a large surface area. The collector is periodically emptied into a bucket, which could be provided with a transparent indicator to give a visual indication of the filling level, or for very large areas a small, low-power, portable electric or other pump could be used to pump out the liquid collected in the collector periodically or continuously.

Figure 14:
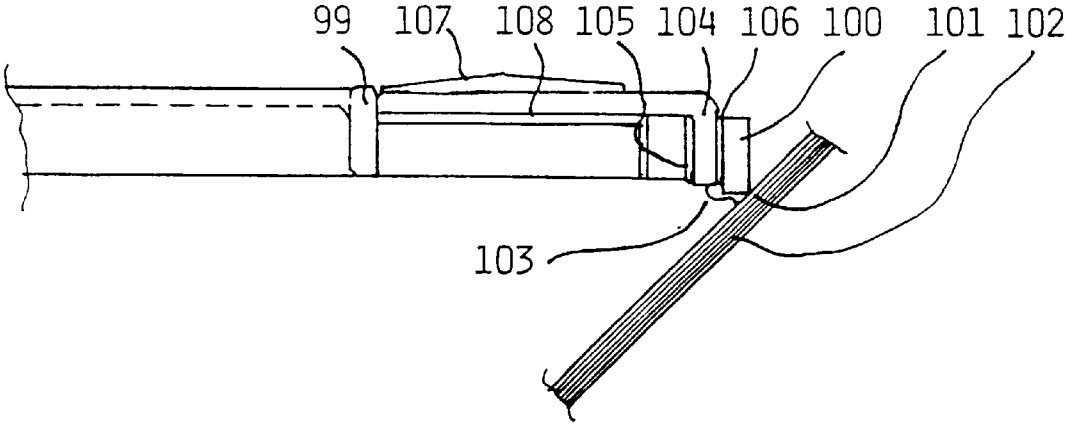
FIG. 14 shows another version of the implement of the invention with a frontal disposition of the drying blade.

FIG. 14 which is a variant on FIG. 4 shows a disposable drying implement having a drying blade 100 disposed vertically relative to the body 99, its outside edge 101 bearing against the surface 102 to be dried. The bead 103 transfers of itself to its other side where it is captured by the substrate 104 slipped into housings 105 separated into compartments by thin walls for retaining the exterior support 106 to which the vertical blade 100 is glued. This disposition of the drying and recovery head renders this type of implement non-reusable, i.e. disposable when the substrate 104 is saturated with dirt in suspension in the liquid. The rear of the substrate includes a wringer plate 107 contained in its protection and fixing net which is glued to an apertured surface 108 of the body 99 for removal of the liquid containing the dirt. The body 99 is very light in weight and very low in cost.

Figure 15:
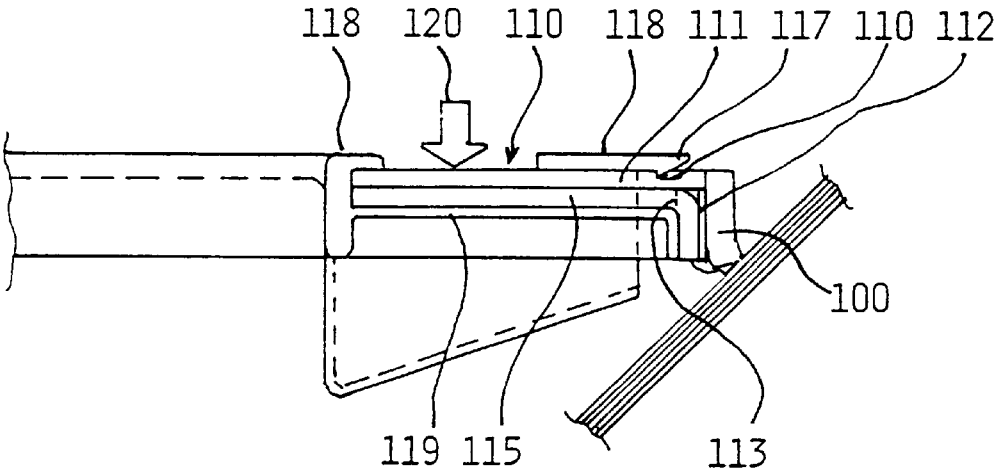
FIG. 15 shows the version from FIG. 14 equipped with a removable and interchangeable drying head.

FIG. 15 shows a version of FIG. 14 in which the drying and recovery head 110 can be removed by unclipping it. This head is a plate 111 having at its front end a 90° flange 112 stiffened by ribs 113. The drying blade 114 is glued to the outside face of the flange 112. The capillary substrate 115 is fixed by a net to the plate 111. It is notched at the front to engage between the stiffener ribs 113.

The support plate 111 is notched at 116 to receive at least one clip 117 for immobilizing it on the body 118 of the implement. The substrate 115 rests on an apertured web 119 for removal of excess liquid upon pressing on the rear of the plate 111 at the location of the arrow 120. A recovered liquid collector shown in dashed line can be used.

Figure 16:
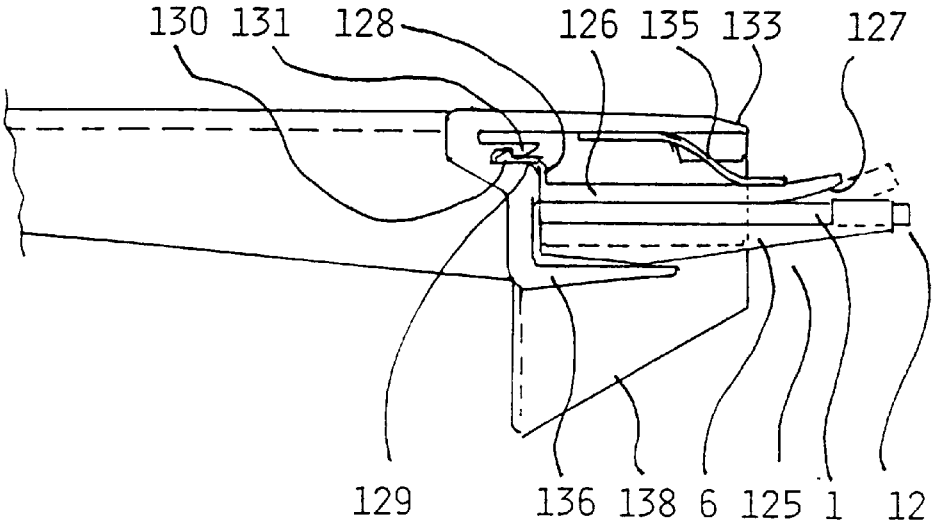
FIG. 16 shows an implement including a drying head with automatic drying each time the drying blade is removed from contact with the surface to be dried.

FIG. 16 shows another example of an interchangeable drying head 125 including a blade 1 and its capillary substrate inside the net of which is a pressure plate 66, as in FIG. 5, but disposed the opposite way round.

The blade 1 is glued to a support plate 126 that clips into a corresponding housing 127 of the body 128 of the implement. The plate 126 has a curve 127 for limiting flexing of the blade 1 at its free end, a bend 128 and a complementary bend 129 carrying a clip 130 engaged in a complementary clip 131 on the body 132. The body includes an abutment 133 for limiting the bending travel of the plate 126, pivoted at the bends 129, 130 and extending as far as the base of the curve 127 of the plate 126. At least one metal or plastics material leaf spring 135 fastened to the abutment 133 normally holds the plate 126 in the bottom position in which the substrate 6 is compressed by its pressure plate 66 against an abutment 136 on the body. When the leading edge 12 of the blade 1 is pressed onto the surface to be dried, the blade bends elastically and espouses the curve 127 of the plate 126, which bends in turn and bears on the bottom of the abutment 133. This double bending frees the pressure plate 66 and the substrate is no longer compressed and is in a condition to capture the liquid containing the dirt.

When the blade 1 is lifted from the surface, the spring 135 presses the plate 126 into the bottom position, which automatically wrings out excess liquid into a collector 138. To be able to change the drying head, cut-outs are provided in the abutment 133 in line with the clipping areas. To prevent lateral bending of the blade relative to the body, guide slides can be added between the plate 126 and the abutment 133. This elastic wringing out arrangement can be used on the various types of implement.

Figure 17:
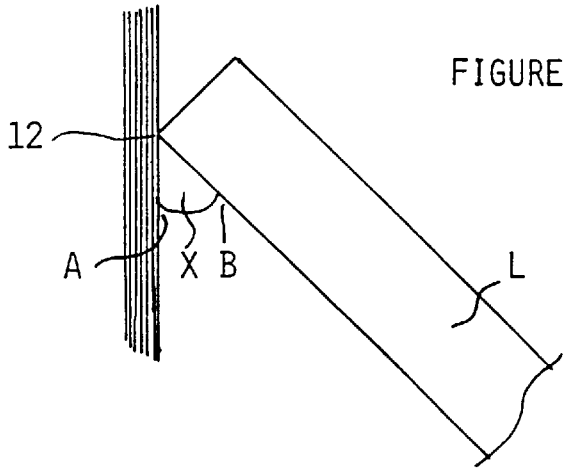
FIGS. 17, 18 and 19 show the physical forces operating in a bead of liquid containing dirt in suspension and/or in dispersion.
Figure 18:
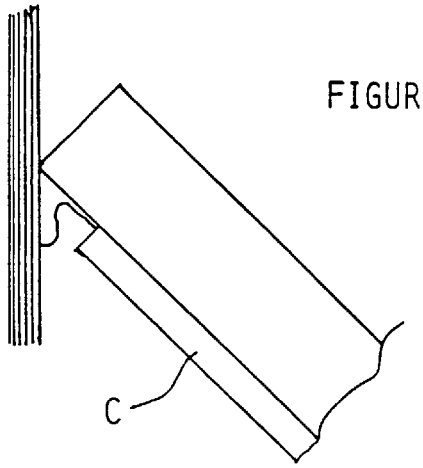
Figure 19:
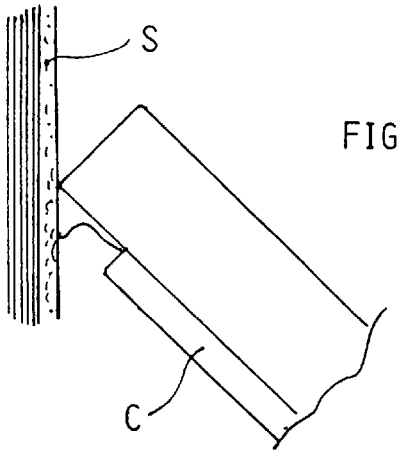

FIGS. 17, 18 and 19 show the physical forces operating in the bead of liquid containing dirt in suspension and/or in dispersion.

FIG. 17 shows the bead on a conventional drying blade with substantially equal surface tensions at A and at B and an intermediate surface tension X in the bead of liquid.

FIG. 18 shows the effect of the capillary substrate C on the bead. If the blade L has an optimized "spreading capability", the surface tension at B is eliminated. The bead spreads at the point of contact with the capillary substrate C set back 3 to 4 millimeters from the leading edge 12 of the blade L.

FIG. 19 shows the moment of contact of the liquid S with the capillary substrate C. The capillary action of the substrate comes into play immediately in co-operation with the liquid retention force R, because of its own surface tension. The more absorbent the substrate, the more accentuated this phenomenon. The choice of the material of the drying blade L is of great importance in terms of the liquid spreading phenomenon.

The best results are obtained by the conjugate effect of the absorption capacity of the substrate, the liquid retention capacity due to its surface tensions and the material of the blade L.

What is claimed is:

1. An implement for drying a surface and for simultaneously recovering a liquid initially on the surface, comprising:

a drying blade of flexible material secured to a hand-held support, said drying blade having a linear leading edge for scraping the surface and for drying the surface by establishing a bead of the liquid behind the leading edge on an inside face of said drying blade and a substrate having a face fixed to a face of the drying blade adjacent the linear leading edge, and which collects the bead of the liquid established behind the linear leading edge, to constitute a drying and liquid recovery head.

2. An implement according to claim 1, wherein the substrate is an absorbent or highly capillary substrate fixed to said drying blade on the inside face thereof, set back from said linear leading edge, and extending along the entire length of said drying blade.

3. An implement according to claim 1, wherein said substrate also partially covers lateral sides of said drying blade.

4. An implement according to claim 1, wherein a front portion of said substrate is situated in a zone in which the bead of said liquid is formed.

5. The implement of claim 4, wherein the bead of liquid is formed about 0.5 mm from said linear leading edge of said drying blade.

6. An implement according to claim 1, wherein said substrate comprises a spongy body, a cloth resulting from the superposition of a plurality of pieces of non-wovens, or a very absorbent material in which the fibers are oriented so that the liquid picked-up is transferred towards a back portion of the drying blade.

7. An implement according to claim 6, wherein said substrate comprises a cloth that results from superposing a plurality of pieces of non-wovens, said non-wovens being disposed in a stepped configuration in a direction towards the back of said drying blade, said cloth being fixed directly beneath said drying blade or said cloth being disposed in a housing provided in said drying blade.

8. An implement according to claim 1, wherein said substrate contains absorbent crystals in its structure.

9. The implement of claim 8, wherein the absorbent crystals are crystals of silica gel.

10. An implement according to claim 1, wherein said substrate is disposed in a fine mesh net made of a material that withstands mechanical wear, heat, and detergents, the net being glued directly beneath the drying blade and to lateral sides thereof.

11. An implement according to claim 1, wherein said drying and liquid recovery head also includes means for squeezing out said substrate, optionally coupled to a collector for collecting liquid removed from the head.

12. An implement according to claim 11, wherein said drying and liquid recovery head includes a squeezing out presser disposed behind the substrate and constituted by a pivoting presser plate pressing against said substrate and manually operable by means of a lever pivoted to the body of the implement and to said presser plate, or by a presser plate included in a net for protecting and fixing the substrate beneath the drying blade.

13. An implement according to claim 1, wherein said drying and liquid recovery head is interchangeable, with the top of the drying blade being glued beneath a support of injected plastics material including lateral guide means and clip means engaging in a housing in said implement provided with corresponding guide and clip means, or glued to the body of a disposable scraper.

14. An implement according to claim 1, wherein said hand-held support is provided with a sponge, means for dispensing a detergent liquid, means for dispensing steam or a combination thereof.

15. An implement according to claim 1, further comprising an electromechanical device for picking up the liquid that accumulates while the drying blade is being moved over the surface.

16. An implement according to claim 1, further comprising a body having a removable drying and liquid recovery head attached thereto, said head comprising a drying blade glued in an inclined internal housing provided at the end of a plate, and the substrate in the form of a thick cloth in a protective and fixing net bearing against an apertured support fixed behind said blade beneath said plate;

said body including a first compartment for receiving solids making their way through the substrate, a second compartment for receiving sludge made up of undissolved dirt and a collecting tank; and said implement further comprising means for squeezing a back portion of the substrate, the means being constituted by plate pivoted on the end of a lever, itself pivoted to said body and provided with a presser handle.

17. An implement according to claim 1, further comprising a body having a substantially vertical end wall on a front portion of which the drying blade is glued, the substrate being engaged behind said blade and extending above it, being fixed to an apertured wall of said body by a protective and fixing net, including a presser plate.

18. An implement according to claim 1, further comprising a body on which a removable drying and liquid recovery head is attached, said head being clipped via a plate which includes a flange at an end remote from said body, said flange extending at 90° relative to the axis of the plate, being stiffened by ribs and having the drying blade glued vertically on the outside face thereof, the substrate being fixed beneath said plate by a protective and fixing net, resting on an apertured web secured to said body, and being notched at a front portion to engage between said stiffening ribs.

19. An implement according to claim 1, wherein the drying and liquid recovery head includes a drying blade beneath which the substrate is fixed by means of a net including a presser plate, said drying blade being glued beneath a plate attached in a corresponding housing in the implement, the free end of said plate including a curve for limiting bending of the drying blade and bends acting as a pivot for the plate between a top abutment and a bottom abutment for limiting the bending stroke of said plate, at least one leaf spring holding said plate in a low position in which the substrate is compressed by its presser plate edge when the leading edge of the blade is pressed against the surface to be dried, the plate the pressing against the top abutment.

* * * * *